US010240369B2

(12) United States Patent
Lane et al.

(10) Patent No.: US 10,240,369 B2
(45) Date of Patent: Mar. 26, 2019

(54) VEHICLE DOOR HANDLE ASSEMBLY FOR DIFFERENT THICKNESS DOORS

(71) Applicant: TriMark Corporation, New Hampton, IA (US)

(72) Inventors: Christopher M. Lane, New Hampton, IA (US); Scotty L. Marr, New Hampton, IA (US)

(73) Assignee: TriMark Corporation, New Hampton, IA (US)

( * ) Notice: Subject to any disclaimer, the term of this patent is extended or adjusted under 35 U.S.C. 154(b) by 349 days.

(21) Appl. No.: 15/013,771

(22) Filed: Feb. 2, 2016

(65) Prior Publication Data

US 2017/0218666 A1 Aug. 3, 2017

(51) Int. Cl.
*E05B 79/06* (2014.01)
*E05B 63/00* (2006.01)

(52) U.S. Cl.
CPC ..... *E05B 79/06* (2013.01); *E05B 63/006* (2013.01)

(58) Field of Classification Search
CPC . Y10T 292/57; Y10T 292/85; Y10T 70/5761; Y10T 29/49826; Y10T 16/44; Y10T 16/458; Y10T 16/459; E05B 79/06; E05B 85/12; E05B 5/00; E05B 85/10; E05B 13/005
USPC ..... 292/336.3, 348, 357, DIG. 27, DIG. 31
See application file for complete search history.

(56) References Cited

U.S. PATENT DOCUMENTS 5,377,450 A * 1/1995 Varajon ..... E05B 85/12 292/336.3
6,398,465 B1 * 6/2002 Monge ..... B23B 47/287 279/143
8,881,564 B2 11/2014 Burns et al.
2003/0111848 A1 * 6/2003 Hansen ..... E05B 31/0092 292/336.3
2005/0257389 A1 * 11/2005 Pierson ..... E05B 17/06 33/194
2006/0086161 A1 * 4/2006 Johansson ..... E05B 9/08 70/208
2012/0272695 A1 11/2012 Pickar
2014/0015261 A1 1/2014 Burns et al.

OTHER PUBLICATIONS

Knapheide T Handle Patent Search, "The following are key functional details included in the Knapheide T Handle: Mounting", Nov. 30, 2015, 20 pages. Nov. 30, 2015.

* cited by examiner

*Primary Examiner* — Mark A Williams
(74) *Attorney, Agent, or Firm* — McKee, Voorhees & Sease, PLC

(57) ABSTRACT

A handle and latch assembly is provided for a vehicle door and includes a housing, a latch on the housing and a handle on the housing. A mounting bracket secures the housing to the door using screws with the door being sandwiched between the housing and the mounting bracket. The mounting bracket can be positioned in multiple orientations to accommodate doors having different thicknesses. The housing includes tapered pins that that press fit onto the mounting bracket to provide a temporary hands-free positioning of the assembly into the door until the mounting screws are installed.

15 Claims, 11 Drawing Sheets

VEHICLE DOOR HANDLE ASSEMBLY FOR DIFFERENT THICKNESS DOORS

BACKGROUND OF THE INVENTION

Compartment doors and the like typically have a handle and latch assembly which is mounted on the outside of the door and secured with a bracket on the inside of the door. Often, the different manufacturers of vehicle doors have doors with different thicknesses, which necessitates the use of different mounting brackets with the handle assembly for each of the different door thicknesses. The need for multiple mounting brackets inherently increases the cost of the handle assembly and can complicate installation of the handle assembly since the installer must choose among the various mounting brackets.

Installation of the door handles is also tricky or difficult, and may require two people since the handle assembly is held in one hand and the mounting bracket held in the other hand. Thus, a third hand is typically needed to install the screws which connect the mounting bracket to the handle housing so as to sandwich the door between the bracket and housing.

Therefore, an improved door handle assembly is needed to simplify the installation process and to reduce costs.

An important and primary objective of the present invention is the provision of an improved door handle assembly which overcomes the problems of the prior art.

Another objective of the present invention is the provision of a door handle assembly utilizing a mounting bracket which can be positioned in multiple orientations to accommodate doors having different thicknesses.

A further objective of the present invention is the provision of a mounting bracket for a door handle assembly which can be positioned in four different orientations so as to accommodate four different thicknesses of doors.

Yet another objective of the present invention is the provision of a handle assembly for a door which can be installed by one person without the use of clamping or holding devices.

Another objective of the present invention is the provision of an improved handle assembly for a door which can be quickly and easily installed on various doors of various manufacturers.

Yet another objective of the present invention is the provision for a housing that includes tapered pins that press fit onto the mounting bracket providing a temporary hands-free positioning of the assembly into the door until the mounting screws are installed.

A further objective of the present invention is the provision of an improved handle and latch assembly for a door which is economical to manufacture and durable, secure, and safe in use.

These and other objectives will become apparent from the following description of the invention.

SUMMARY OF THE INVENTION

A handle assembly is provided for vehicle doors. The assembly includes a housing, a latch on the back of the housing moveable between latched and unlatched positions relative to the door frame, and a handle on the front of the housing to move the latch between the latched and unlatched positions. The assembly also includes a mounting bracket which can be mounted to the housing in a plurality of orientations so as to accommodate doors having different thicknesses.

The housing of the handle assembly also includes tapered pins so as to press fit the mount brackets onto the handle in the cutout of the door, and thereby retain the housing on the door until the mounting screws are installed to the handle assembly to the door. These mounting pins allow the assembly to be easily installed by one person.

DETAILED DESCRIPTION OF THE PREFERRED EMBODIMENTS

Figure 1:
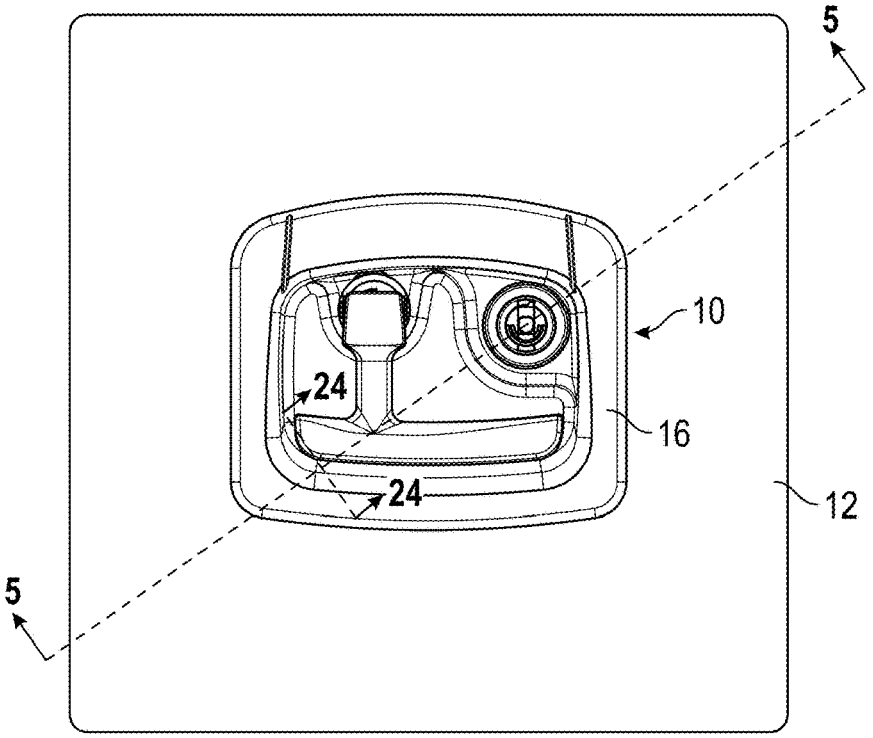
FIG. 1 is a front elevation view of the door handle and latch assembly of the present invention.
Figure 2:
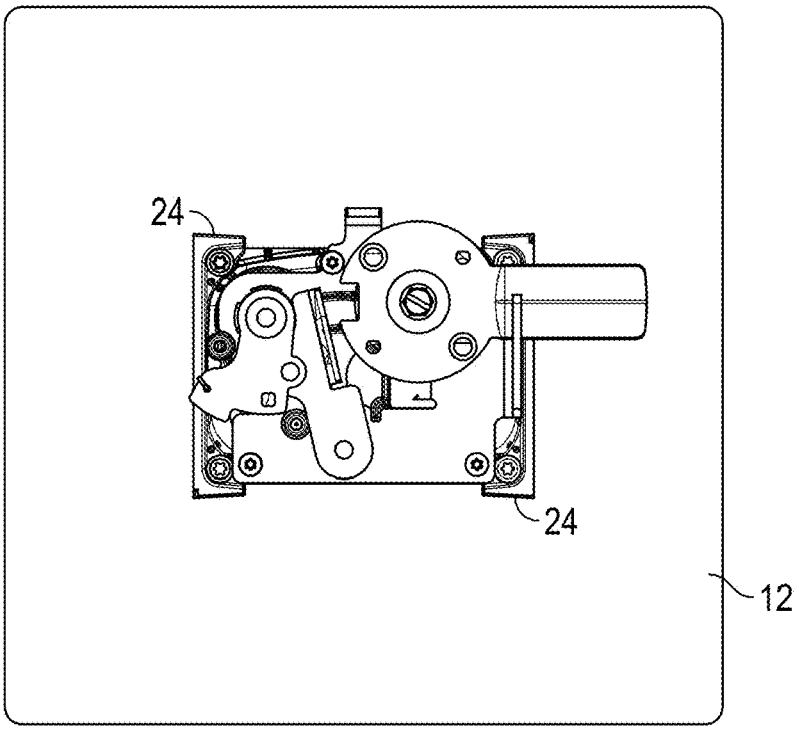
FIG. 2 is a rear view of the handle assembly showing the mounting bracket of the present invention in a first orientation for a relatively thin door.
Figure 3:
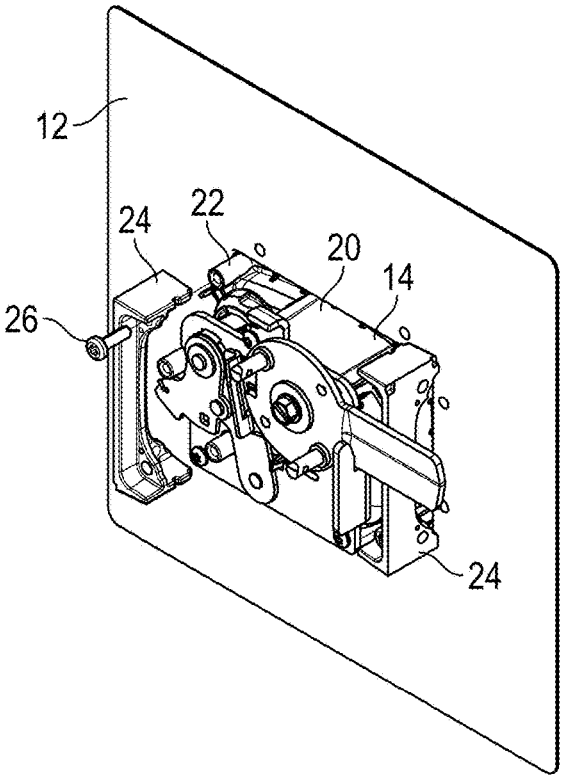
FIG. 3 is a partially exploded rear perspective of the handle assembly with the mounting bracket in the first orientation.
Figure 4:
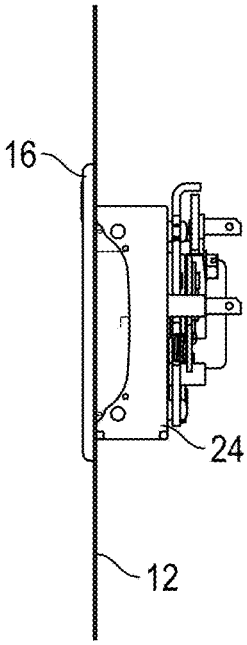
FIG. 4 is a side elevation view of the handle assembly and mounting bracket of the present invention in the first orientation.
Figure 5:
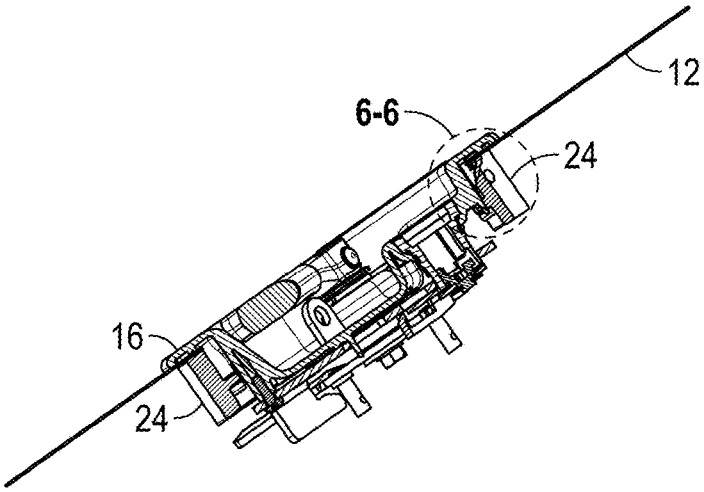
FIG. 5 is a sectional view taken along lines 5-5 of FIG. 1 with the bracket.
Figure 6:
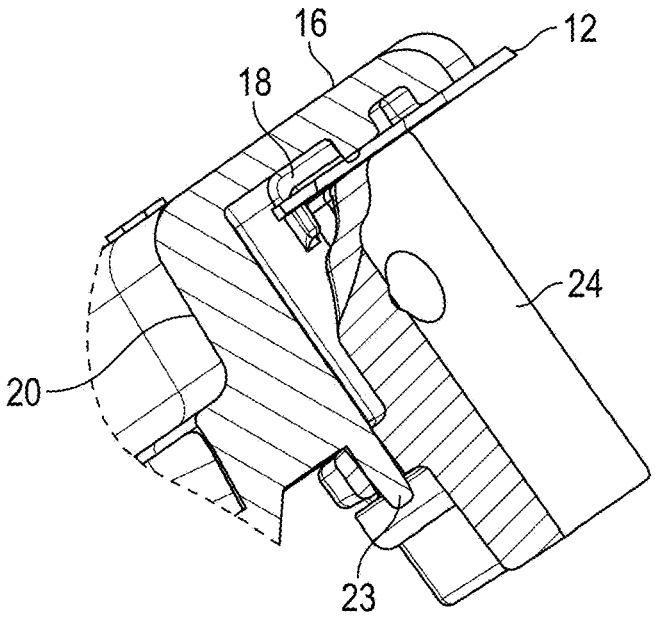
FIG. 6 is an enlarged view taken along lines 6-6 of FIG. 5.

A door handle and latch assembly according to the present invention is designated in the drawings by the reference number 10. The structure and components of the assembly 10 are described in applicant's co-pending application entitled, "Twist Latch for Compartment Door", filed Feb. 2, 2016, which is incorporated herein by reference.

The present invention is directed towards the mounting of the handle and latch assembly 10 to the door 12. The door 12 includes a cutout into which the handle housing 14 extends through so that a mounting bracket 24 can be installed, which will sandwich the door 12 between the housing 14 and the mount bracket 24. More particularly, the housing 14 includes a front lip or flange 16 which engages the front surface of the door 12, with a gasket 18 there between to provide a water-tight seal. The well 20 of the housing 14 extends through the door cutout. Each exterior corner of the well 20 includes a tapered pin 23 which defines a tapered interface for the mount bracket taper pin holes 31. As the well 20 is inserted through the door cutout, the tapered pins 23 provide a frictional engagement with the taper pin holes 31 of the mount bracket 24 and thereby hold the housing 14 in place, without the need for the installer to manually hold the housing 14 against the door. The installer can then secure the handle and latch assembly 10 to the door 12 using a pair of mounting brackets 24 and screws 26 on the opposite ends of the housing 14. The pins 23 thus provide a temporary hands-free positioning of the assembly 10 in the door 12 until the mounting screws 26 are installed.

Figure 7:
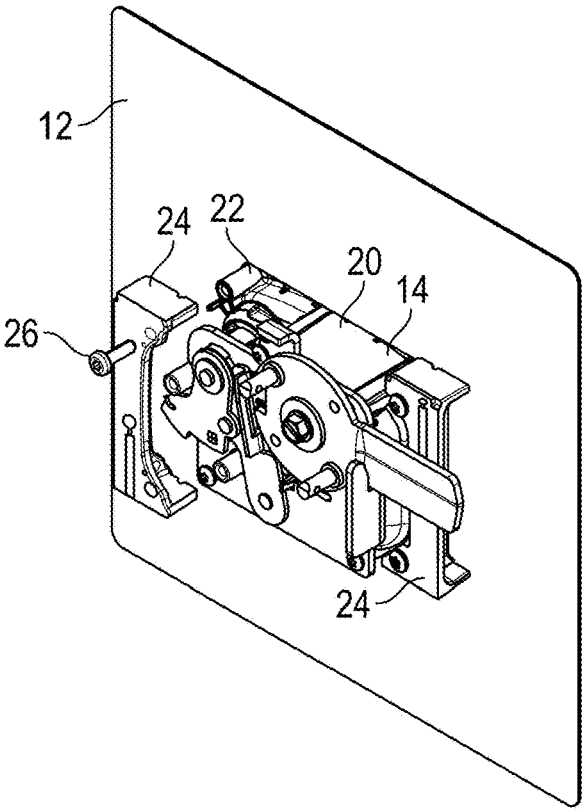
FIG. 7 is a partially exploded rear perspective view of the handle assembly with the mounting bracket in a second orientation for a slightly thicker door application.
Figure 8:
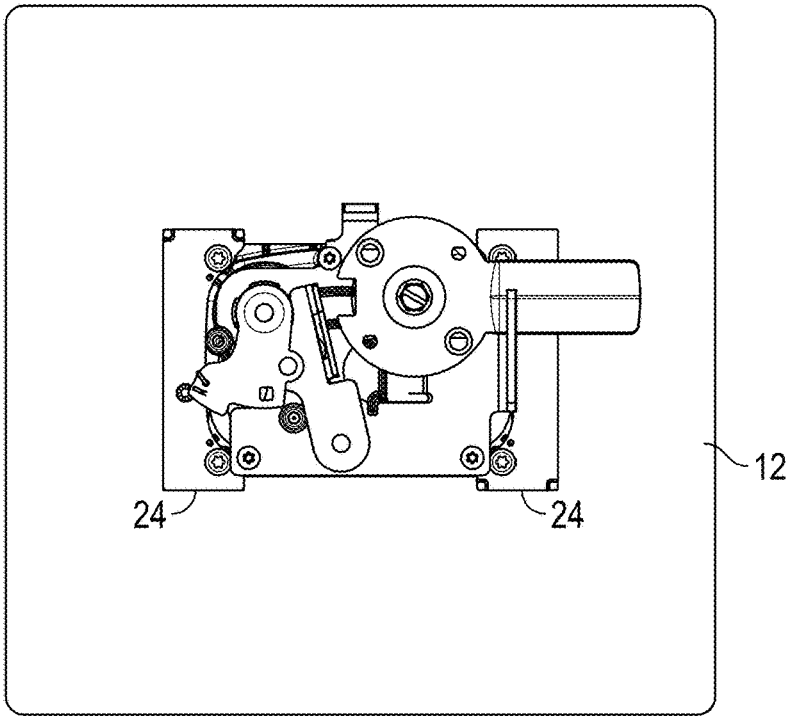
FIG. 8 is a rear elevation view of the handle assembly and mounting bracket in the second orientation.
Figure 9:
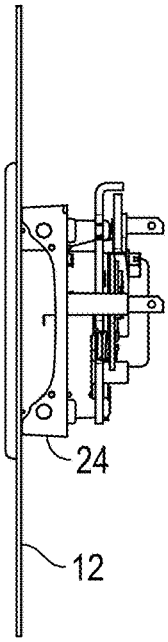
FIG. 9 is a side elevation view of the handle assembly and mounting bracket in the second orientation.
Figure 10:
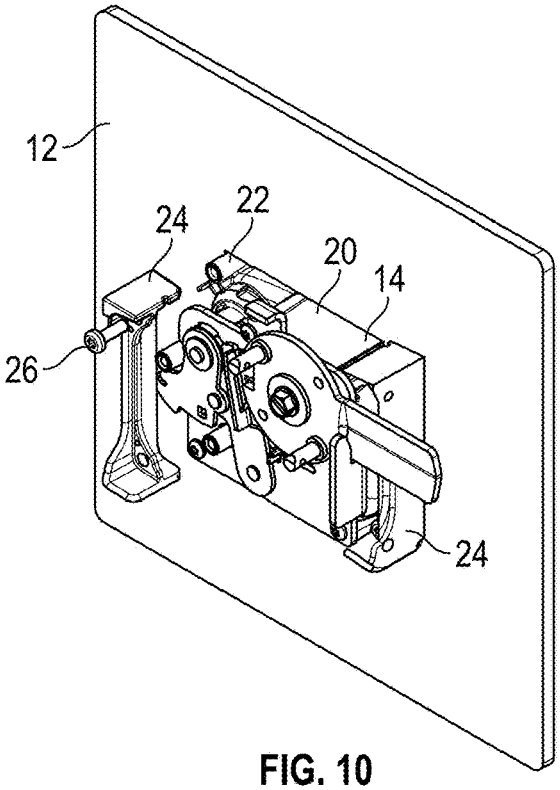
FIG. 10 is a partially exploded rear perspective view of the handle assembly with the mounting bracket in a third orientation for an even thicker door.
Figure 11:
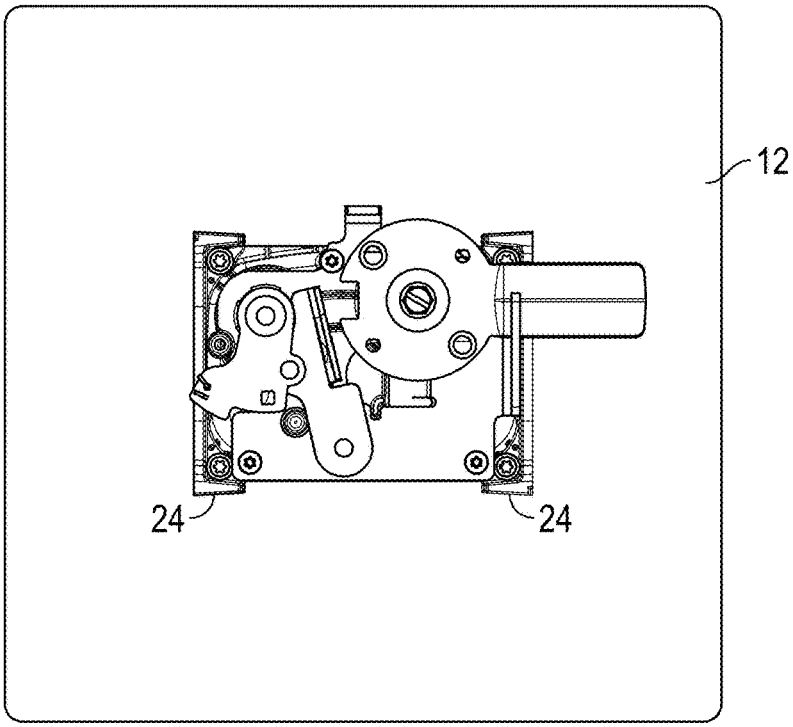
FIG. 11 is a rear elevation view of the handle assembly with the mounting bracket in the third orientation.
Figure 12:
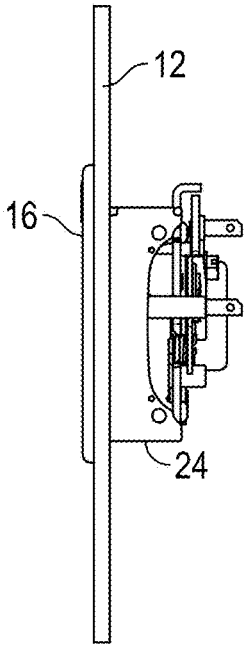
FIG. 12 is a side elevation view of the handle assembly with the mounting bracket in the third orientation.
Figure 13:
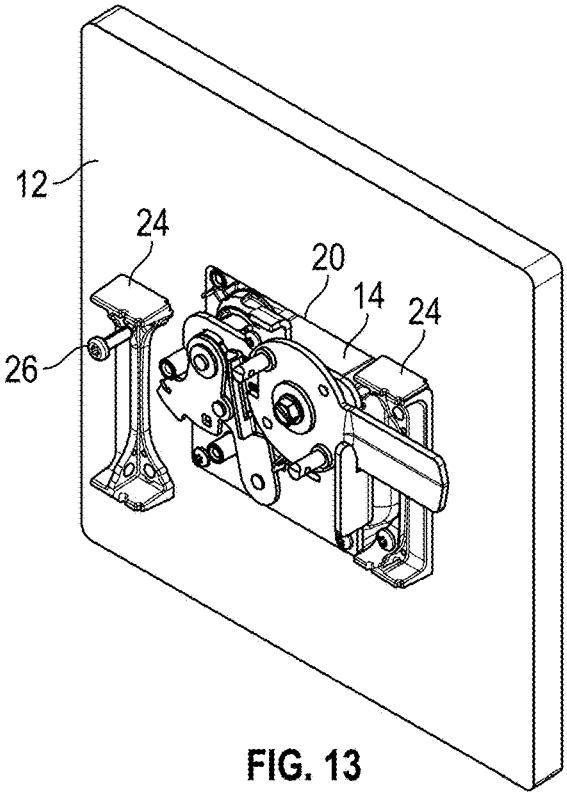
FIG. 13 is a partially exploded rear perspective view of the handle assembly with the mounting bracket in a fourth orientation for the thickest door.
Figure 14:
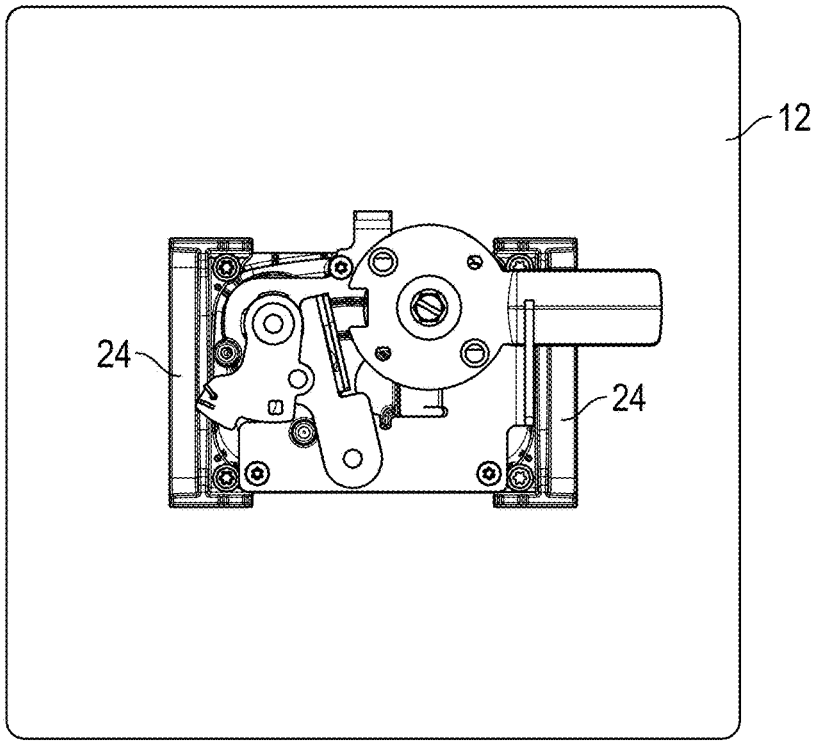
FIG. 14 is a rear elevation view of the handle assembly with the mounting bracket in the fourth orientation.
Figure 15:
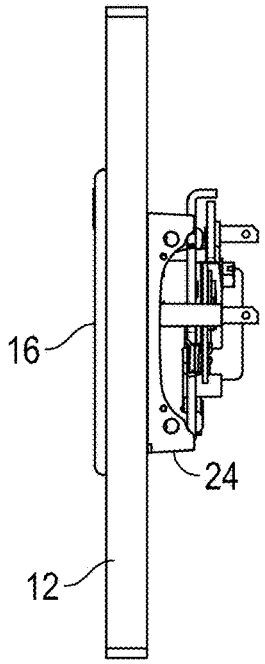
FIG. 15 is a side elevation view of the handle assembly with the mounting bracket in the fourth orientation.
Figure 16:
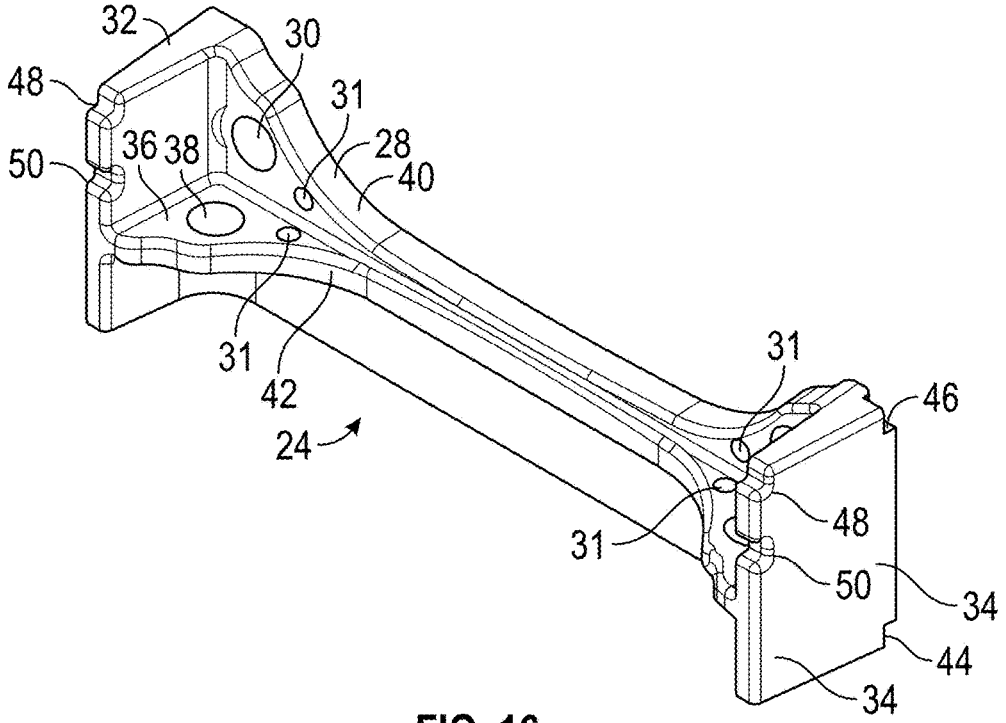
FIG. 16 is a perspective view of the mounting bracket.
Figure 17:
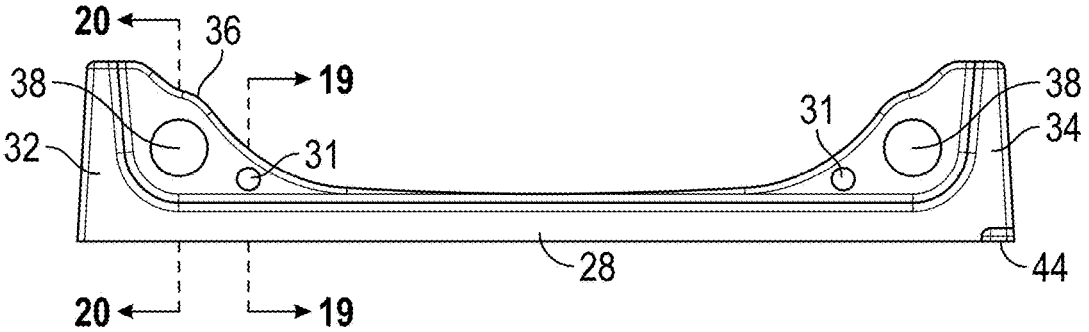
FIG. 17 is a top view of the mounting bracket shown in FIG. 16.
Figure 18:
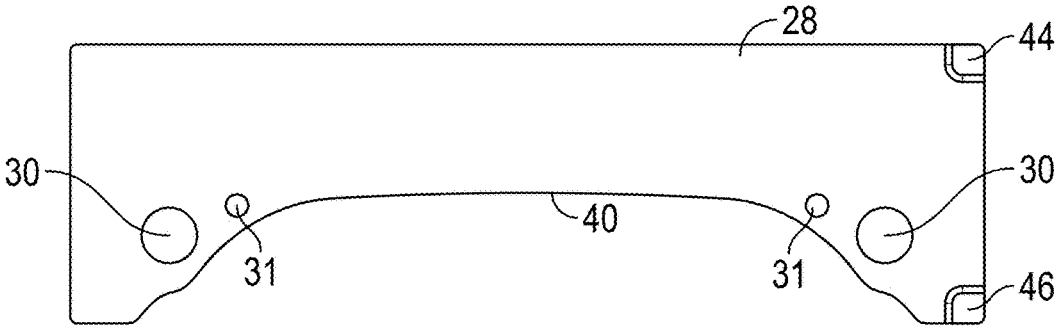
FIG. 18 is a front elevation view of the mounting bracket.

The mounting bracket 24 can be oriented in four different positions so as to accommodate doors having different thicknesses. FIGS. 2-6 show the bracket 24 in a first orientation for use on a relatively thin door, such as a 0.035 inch thickness. FIGS. 7-9 show the bracket 24 in a second orientation for a slightly thicker door, such as a door having a thickness of 0.075 inch. FIGS. 10-12 show the bracket 24 in a third orientation for an even thicker door, of an approximately 0.250 inch thickness. It is understood that the dimensions of the bracket 24 can be modified for other door thicknesses. FIGS. 13-15 show the bracket 24 in a fourth orientation for the thickest door, of approximately 0.625 inch.

Figure 19:
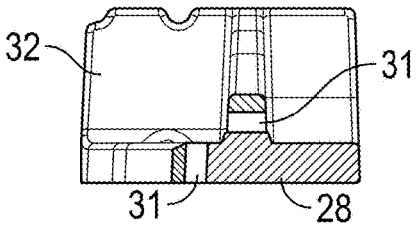
FIG. 19 is a sectional view along lines 19-19 of FIG. 17.
Figure 20:
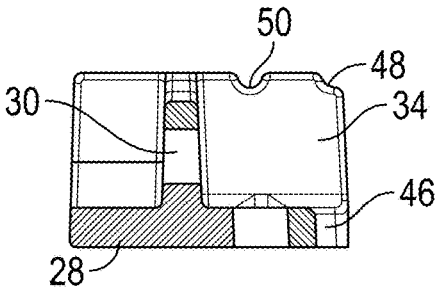
FIG. 20 is a sectional view taken along lines 20-20 of FIG. 17.
Figure 21:
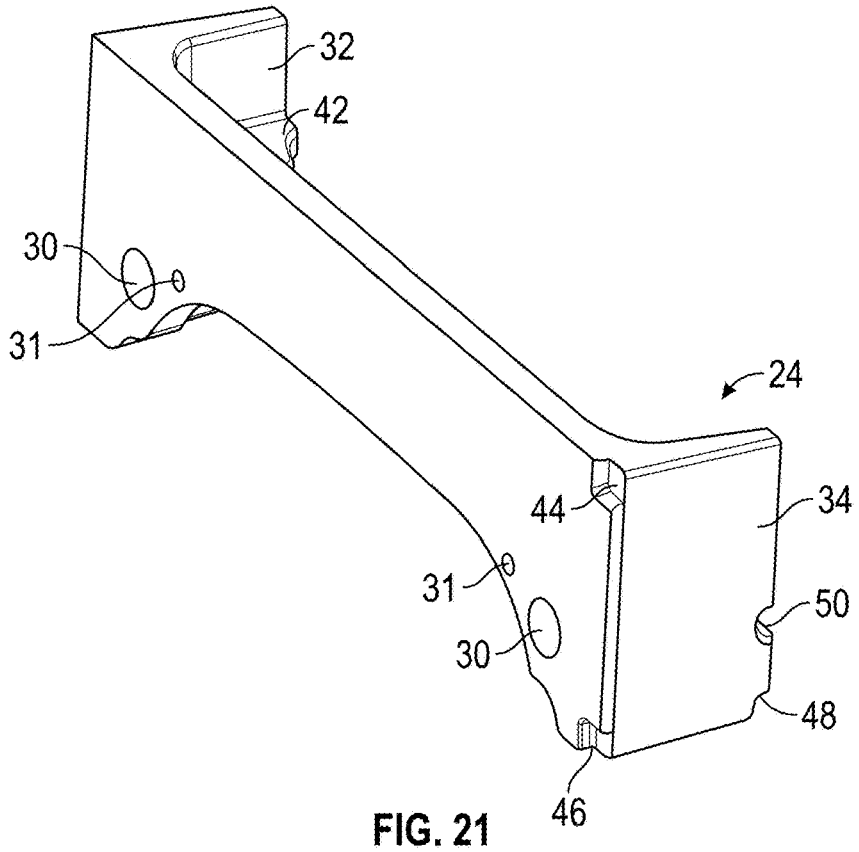
FIG. 21 is another perspective view of the mounting bracket.
Figure 22:
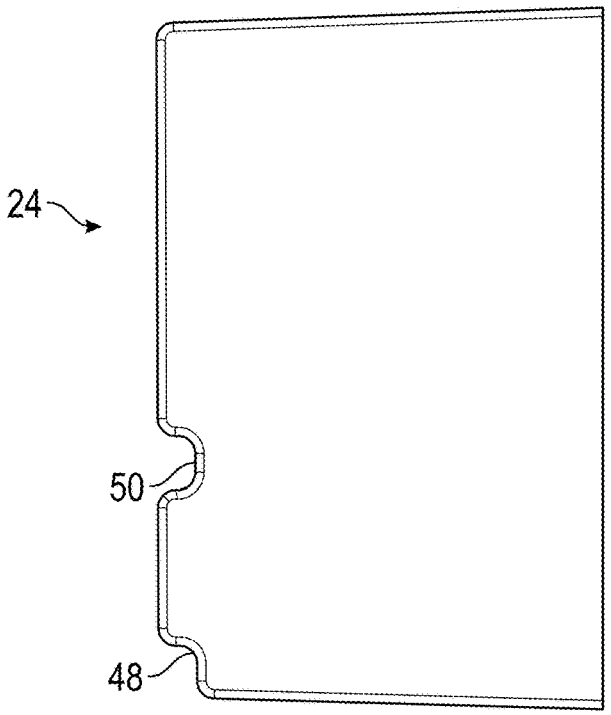
FIG. 22 is an end elevation view from one end of the bracket.
Figure 23:
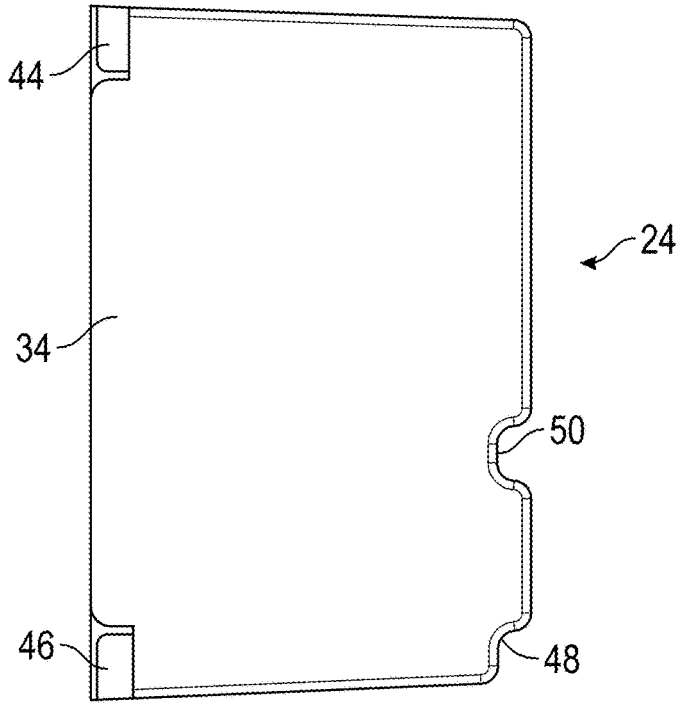
FIG. 23 is an end elevation view of the mounting bracket from the opposite end of FIG. 22.
Figure 24:
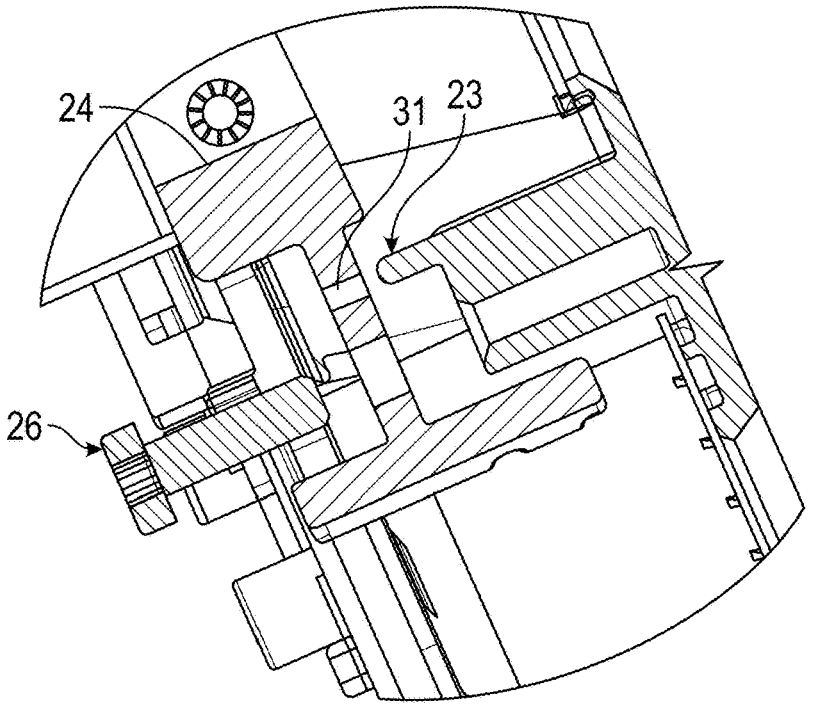
FIG. 24 is an enlarged sectional view taken along lines 24-24 to FIG. 1 and showing the housing and mounting bracket in an initial stage of installation before the tapered pin of the housing is inserted into the pin hole of the mounting bracket.
Figure 25:
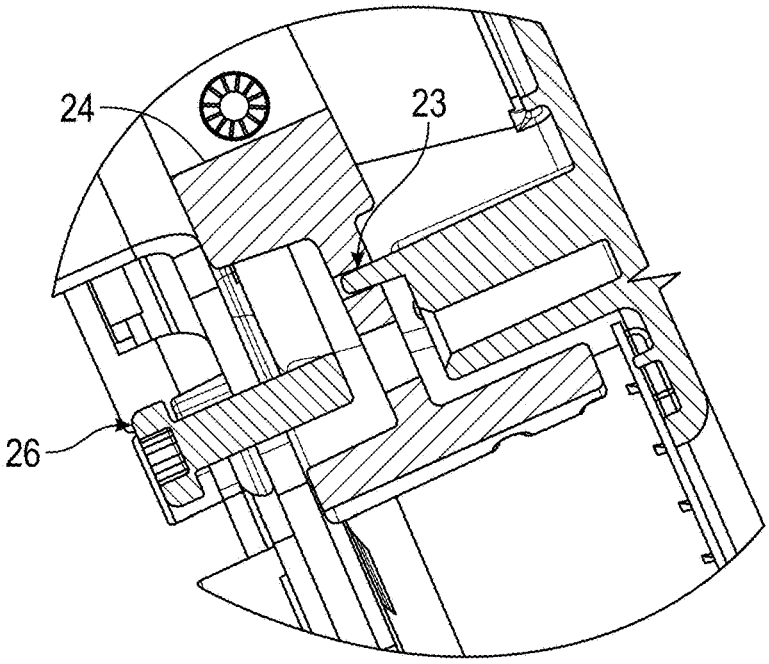
FIG. 25 is a view similar to FIG. 4 showing an intermediate press fit stage of installation with the housing pin partially inserted into the pin hole of the mounting bracket.
Figure 26:
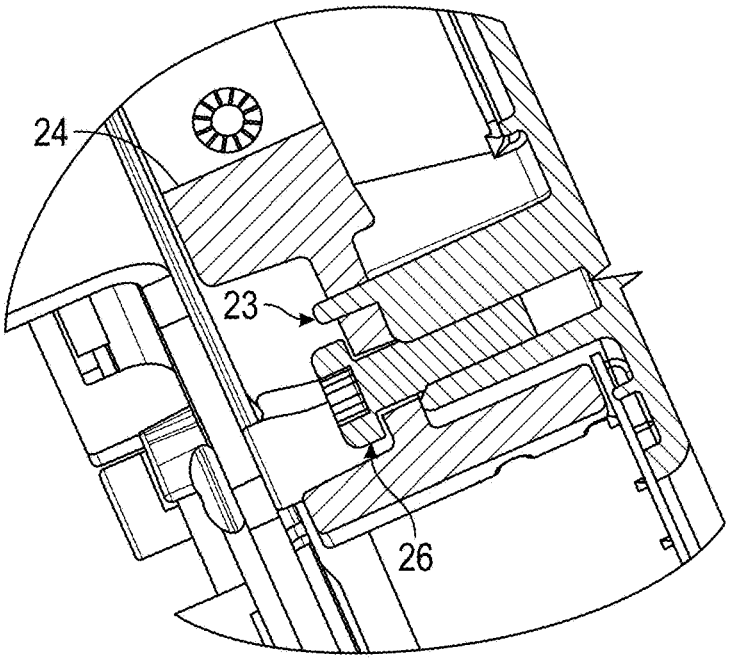
FIG. 26 is a view similar to FIG. 25 showing a final stage of installation, with the tapered pin of the housing fully inserted into the pin hole of the mounting bracket and the securement screw threaded through the bracket and into the housing boss.

The bracket 24 includes a first wall or face 28 having a pair of mount holes 30 at opposite ends. A pair of opposite end walls 32, 34 provide a C-shaped profile for the bracket 24. An internal wall or rib 36 extends perpendicular to the first wall 28 and the end walls 32, 34. The wall 36 is not centered between the end walls 32, 34, but rather is offset, as best seen in FIGS. 19 and 20. A pair of mount holes 38 extend through wall 36 adjacent each of the end walls 32, 34.

Each of the sets of taper pin holes 31 provide four alternative orientations for the mounting bracket 24 on the mount bosses 22 for receipt of the screws 26. It is noted in the drawings, FIGS. 3, 7, 10 and 14 only show one mounting screw 26, but it is understood that a second screw 26 is also used to secure the mounting bracket 24 to the mount bosses 22.

In the first bracket orientation shown in FIGS. 2-6, the wall or rib 36 is positioned such that a notch or cutout 40 in the wall 28 faces forwardly towards the lip 16 of the housing 14. In the second orientation, the cutout 40 matingly engages the housing well 20 with the end walls 32, 34 facing forwardly towards the housing lip 16. In the third orientation, the interior wall or rib 36 is positioned on the bosses 22 with a cutout 42 in the wall 36 matingly engaging the well 20 and the cutout 42 in the wall 28 facing forwardly towards the housing lip 16. In the fourth orientation, the wall 28 is positioned on the bosses 22, with the cutout 42 adjacent the housing well 20 and the wall 36 facing rearwardly. Thus, in each of the orientations, a different edge of the mounting bracket 24 engages the interior of the door 12. One of the cutouts 40, 42 resides adjacent the housing well 20 in each of the four orientations. The bracket 24 is rotated 180° end to end and/or 90° side to side in moving between the various orientations. In each orientation, the tapered pins 23 are received in one pair of the holes 31, and from one direction or the other.

Thus, the multiple positions or orientations of the bracket 24 allow the handle and latch assembly 10 to be mounted on different doors having different thicknesses using a single mounting bracket. To assist the installer, indentia are provided on the mounting bracket for each of the positions. The indicia may take various forms. For example, in a preferred embodiment, when the bracket 24 is in the first position, there is a single notch 44 visible from the rear of the assembly 10. In the second position, the first notch 44 and a second notch 46 are visible to the installer to the rear of the assembly 10. In the third position, the notch 46 and two additional notches 46, 48 in the end walls 32, 34 are visible to the installer from the rear of the assembly 10. In the fourth position, the notches 48 and another pair of notches 50 in the end walls 32, 34 are visible to the installer. As an alternative to the notches, the indicia may be any visible marking, formed or added in any convenient manner. Thus, the first position has one visible indicia, the second position has two visible indicia, the third position has three visible indicia and the fourth position has four visible indicia so that the installer can quickly and easily confirm the proper orientation of the mounting bracket 24 on the bosses 22, depending on the door thickness.

The ability to orient the mounting bracket in multiple positions allows the handle assembly to accommodate doors having various thicknesses, and minimizes the number of pieces or parts for the assembly, since a different mounting bracket is not needed for different door thicknesses.

The invention has been shown and described above with the preferred embodiments, and it is understood that may modifications, substitutions and additions may be made which are within the intended spirit and scope of the invention. From the foregoing, it can be seen that the present invention accomplishes at least all of its stated objectives.

What is claimed is:

1. A handle assembly for a vehicle door, the handle assembly comprising:

a housing;

a handle pivotally mounted on the housing to open the door by pivotal movement of the handle;

a mounting bracket for mounting the housing to a vehicle door, the mounting bracket being mountable to the housing in a first orientation during installation of the handle assembly to a first door so that the mounting bracket is configured to accommodate a thickness of the first door; and the handle mounting bracket being mountable to the housing in a second orientation during installation of the handle assembly to a second door so that the mounting bracket is configured to accommodate a thickness of the second door;

wherein the mounting bracket is rotatable during installation between one of the first and second orientations in order to accommodate the thickness of one of the first door and second door; and the thickness of the first door and the thickness of the second door are different thicknesses.

2. The handle assembly of claim 1 wherein the mounting bracket is mountable on the housing in a third orientation during installation of the handle assembly on a third door so that the mounting bracket is configured to accommodate a thickness of the third door, which has a thickness different from the first and second doors.

3. The handle assembly of claim 2 wherein the bracket has first, second and third indicia corresponding to the first, second, and third orientations, respectively.

4. The handle assembly of claim 2 wherein the mounting bracket is mountable to the housing in a fourth orientation during installation of the handle assembly to a fourth door so that the mounting bracket is configured to accommodate a thickness of the fourth door, which has a thickness different from the first, second, and third doors.

5. The handle assembly of claim 4 wherein the bracket has first, second, third and fourth indicia corresponding to the first, second, third, and fourth orientations, respectively.

6. The handle assembly of claim 4 wherein the bracket has four sides with opposite ends, and is rotated end-to-end and ¼ turn side-to-side between the first and second orientations, is rotated ¼ turn side to side between the second and third orientations, and is rotated ¼ side-to-side and end-to-end between the third and fourth orientations.

7. The handle assembly of claim 4 wherein the bracket has a primary face which faces outwardly in the first orientation, rearwardly in the second orientation, outwardly in the third orientations and forwardly in the fourth orientation, relative to a back of the housing.

8. The handle assembly of claim 4 wherein the bracket has a first set of screw holes for receiving screws for mounting in the first and third orientations and a second set of screw holes for receiving screws for mounting in the second and fourth orientations.

9. The handle assembly of claim 1 wherein the bracket has a first indicia corresponding to the first orientation.

10. The handle assembly of claim 9 wherein the bracket has a second indicia corresponding to the second orientation.

11. The handle assembly of claim 1 wherein the bracket has a first set of screw holes for receiving screws in the first orientation and a second set of screw holes for receiving screws in the second orientation.

12. The handle assembly of claim 1 wherein the bracket has four sides and opposite ends, and is rotated end-to-end and ¼ side-to-side between the first and second orientations.

13. The handle assembly of claim 1 further comprising:

tapered pins on the housing to press fit into holes in the mounting bracket during installation of the handle assembly onto the door to temporarily retain the housing in position on the door; and fasteners apart from the pins to secure the housing and mounting bracket together and thereby install the handle assembly on the door.

14. The handle assembly of claim 13 wherein the mounting bracket and the housing sandwich the door between the housing and the mounting bracket.

15. The handle assembly of claim 13 wherein the fasteners are screws threadably coupling the housing to the mounting bracket.

* * * * *